US007325277B2

(12) United States Patent
Pinto

(10) Patent No.: US 7,325,277 B2
(45) Date of Patent: Feb. 5, 2008

(54) FIBER WEB FORMING APPARATUS

(76) Inventor: Akiva Pinto, Narkis Str. 9 A, Jerusaleum (IL) 92481

( * ) Notice: Subject to any disclaimer, the term of this patent is extended or adjusted under 35 U.S.C. 154(b) by 74 days.

(21) Appl. No.: 11/331,909

(22) Filed: Jan. 16, 2006

(65) Prior Publication Data

US 2007/0163087 A1 Jul. 19, 2007

(51) Int. Cl.
*D01G 15/40* (2006.01)

(52) U.S. Cl. ..... 19/105

(58) Field of Classification Search ..... 19/105
See application file for complete search history.

(56) References Cited

U.S. PATENT DOCUMENTS

| | | | |
|---|---|---|---|
| 3,293,700 | A | 12/1966 | Smith |
| 3,829,934 | A | 8/1974 | Neu |
| 4,133,455 | A | 1/1979 | Moser |
| 4,154,889 | A | 5/1979 | Platt |
| 4,240,180 | A | 12/1980 | Wood et al. |
| 4,694,538 | A | 9/1987 | Pinto et al. |
| 4,858,278 | A | 8/1989 | Pinto et al. |
| 4,908,910 | A | 3/1990 | Pinto et al. |
| 5,018,245 | A | 5/1991 | Marzoli et al. |
| 5,044,046 | A | 9/1991 | Pinto et al. |
| 5,522,119 | A | 6/1996 | Leifeld et al. |
| 5,655,262 | A | 8/1997 | Sterin et al. |
| 6,159,882 | A | 12/2000 | Kean et al. |
| 6,263,545 | B1 | 7/2001 | Pinto |
| 6,421,884 | B2 | 7/2002 | Pinto |
| 6,460,223 | B1 | 10/2002 | Pinto |
| H2105 | H | 6/2004 | Pinto |

FOREIGN PATENT DOCUMENTS

GB 2 335 664 A 9/1999

*Primary Examiner*—Shaun R. Hurley
(74) *Attorney, Agent, or Firm*—McNair Law Firm, P.A.

(57) ABSTRACT

An arrangement for forming a fiber web in which fibers are compacted while remaining evenly distributed through the upper and lower surfaces. The arrangement includes a cabinet for receiving opened and blending fibers, and a fiber web forming chute receiving the fibers from the cabinet. The forming chute includes an upper and a lower wall which engage with and assist with the movement of the fibers through and out of the web forming chute. A packing member is positioned adjacent the exit end, engages with and compresses the emerging fiber web to a desired density and height. An air flow system acts to pass a flow of air through the chute from its entrance. The flow of air engages with the fibers during their passage through the chute. The air flow system includes an air removal system which is located in the upper wall and the packing member. The removal system causes the air to exit the web forming chute upwardly, passing through the web. The air flow engages with fibers forming the web, maintaining the various size fibers evenly distributed throughout the web.

5 Claims, 3 Drawing Sheets

FEED CHUTE
FEED CHUTE
10
12
17
16
15
15′
18′
20′
A
18
24
14
5
24′
22
20
26′
62
26
61
28
60
35
56
36′
44
38′
63
30
46′
42′
37
38
36
34
58′
42
46
61′
32
35′
44′
40
54
48′
48
54′
50′
52
50
50′

FIBER WEB FORMING APPARATUS

BACKGROUND OF THE INVENTION

This is an improvement of my earlier U.S. Pat. No. 6,557,214, issued on May 6, 2003, U.S. Pat. No. 6,421,884, issued on Jul. 23, 2002 and U.S. Pat. No. 6,263,545, issued on Jul. 24, 2001.

The instant invention is directed to a system for forming non-woven fabric or fiber webs having evenly and thoroughly blended fibers through both its upper and lower faces.

Fiber webs or non-woven fabrics are well known throughout the textile industry. Normally, these webs or fabrics are formed by producing carded or air lay webs and passing a plurality of these webs through a cross-lapper to produce the fiber web of sufficient height and weight with the fibers entangled. A major drawback to this system is that the fiber directions are generally in line with the direction of carding thus placing the fibers of the stacked or lapped webs in X, Y positions. This results in a web with less spring-like action.

Another problem with this type of system is that production cannot be efficient in all ranges of fabric weights, and is also limited to the speed of the cross-lapping machine.

It is the object of the instant invention to provide a system capable of producing a fabric web or non-woven fabric in which the fibers are disposed and entangled in all directions thus forming a more lofty fabric in wide range of fabric weights.

Another object of the invention is a system capable of producing non-woven fabrics or fabric webs of even density at increased speeds if light or heavy fabric weight.

Another object of the invention is a system for the production of fiber webs in which the fibers are both evenly distributed and evenly compacted on the upper surface.

Another object of the invention is a system for the production of a non-woven fabric suitable for use as insulation material and slitted material in the height direction.

Another object of the invention is a system for the production of a non-woven fabric in which the fibers are oriented to provide isotropic strength properties to the fabric.

Another object of the invention is a system for producing non-woven fabrics or fiber webs with equal density through its height, width and adjacent both faces.

Another object of the invention is to provide a system for producing non-woven fabrics or fiber webs of high density without a cross-lapper.

Another object of the invention is to provide a system for the production of non-woven webs or fabrics structured with sufficient stability, loft, and resilience to be used as pillow stuffing, upholstery padding, mattress stuffing and other similar products.

Another object of the invention is a system for the production of non-woven webs in which the web is treated during formation in the forming chute with desired materials.

Another object of the invention is a system for the production of a fiber web in which fibers of lesser length are evenly distributed between the outer faces of the fiber web.

SUMMARY OF THE INVENTION

The invention is directed to an arrangement for forming a non-woven fabric with high resilience and a high loft. The arrangement includes a cabinet which receives opened and blended fibers from a fiber feed. Connected with the cabinet is an upwardly directed fiber web forming chute for receiving the opened and blended fibers and forming them into a non-woven fiber web. The forming chute has an upper wall which includes a vibrating plate and a lower wall which includes a packing belt for urging the fibers down the forming chute in an evenly distributed condition throughout the height of the fiber web being formed. An air distribution system is associated with the arrangement for delivering air flow through the forming chute which assists in controlling the distribution and movement of the fibers within the fiber web during formation in the forming chute. The air flow exits the forming chute through its upper wall.

The upper wall includes a hood over the vibrating plate for receiving the air flow through the upper wall. Also, the vibrating plate is perforated which allows the air flow to migrate through the vibrating plate into the hood. The air distribution system includes an outlet conduit which delivers the air flow into the cabinet and into the receiving end of the forming chute. An intake conduit is provided for removing the air flow for the cabinet.

The air distribution system may include a feed unit for supplying to the air flow various elements such as moisture or chemical additives which mingle with and coat fibers within the forming chute. An arrangement for forming a non-woven fabric web with high resilience and high loft including a housing delivering blended and opened fibers into a receiving end of a fiber web forming chute. The forming chute includes an upper wall and a lower wall which are spaced a distance equal the loft of the fiber web. The upper wall comprises a vibrating plate positioned adjacent an upper packing belt. The vibrating plate and upper packing belt each extend across the width of the forming chute and in tandem along its length.

The arrangement further includes a fiber control and web compacting system adjacent the exit end of the fiber web forming chute. The system includes at least one press or packing roll and a conveyor system. The press roll is perforated and connected with the air distribution system. A hood is placed over the press roll. Air passing down the web forming chute through the web, is drawn into and out of the packing roll during compaction of the web. This action helps forming light weight fabrics as 100 gr/m2 in higher speeds or forming very heavy weight like 10 Kg/m2.

The arrangement may include a pair of press rolls arranged on opposite sides of the fiber web, exiting the exit end of the fiber forming chute. Air may or may not be circulated through the lower press roll. The air may be circulated in close or open loop.

The upper packing belt extends along substantially the entire length of the upper wall and the vibrator plate extends along substantially the entire length of said upper wall. The vibrator plate carries the upper packing belt by way of a pair of rolls mounted on opposed ends. One or both of the rolls are driven.

DESCRIPTION OF THE DRAWINGS

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
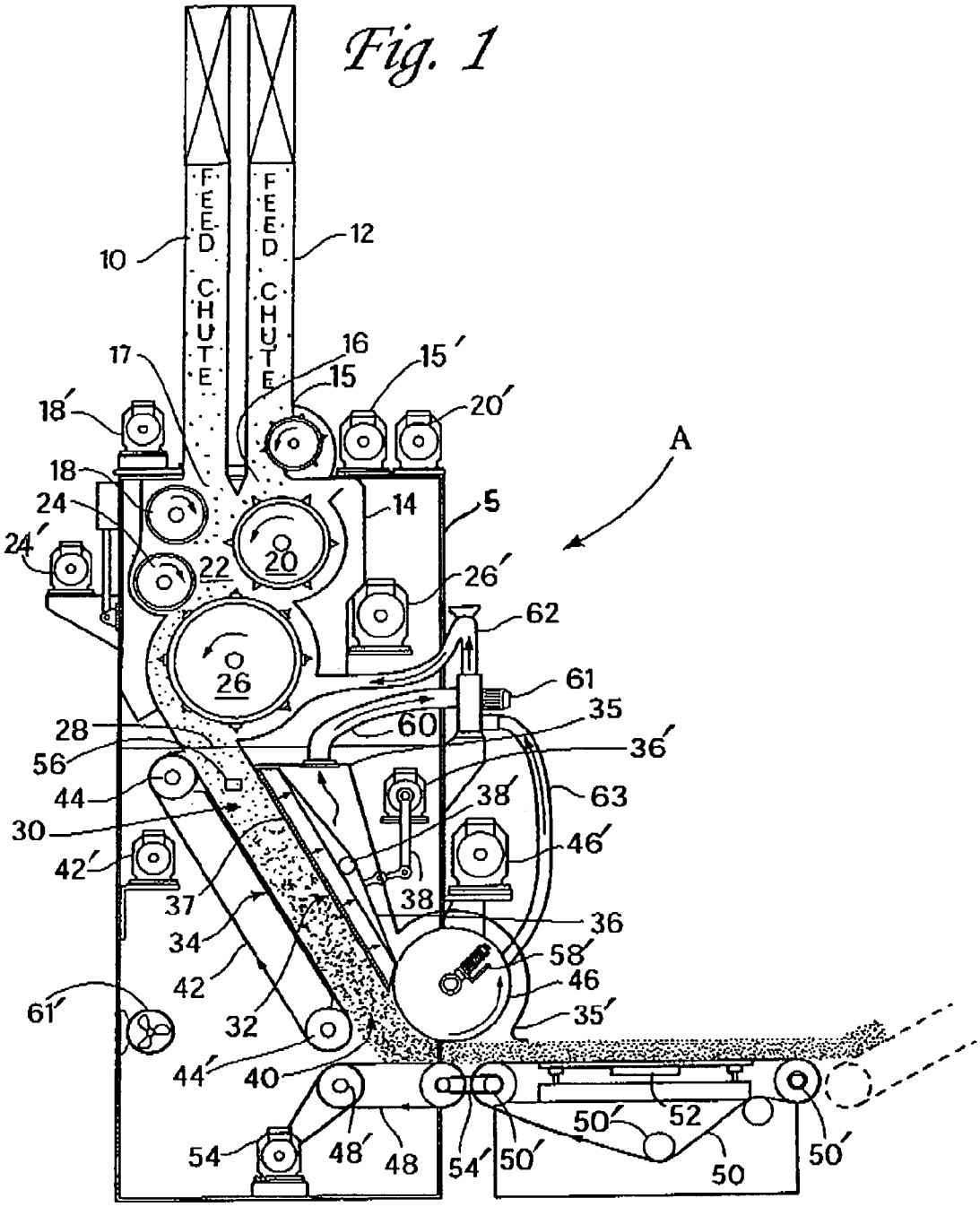
FIG. 1 is a side cutaway view of a first arrangement of a fiber web forming apparatus of the invention.

Turning now to the drawings, in FIG. 1 a first arrangement A of the apparatus for transforming fibers into a non-woven fiber web or fabric is shown. The system begins with a fiber feed system substantially as disclosed in earlier U.S. Pat. No. 6,421,884 and U.S. Pat. No. 6,263,545, which may include carding machines of any known type and which may be arranged side by side or in parallel. The fibers fed through each machine may be maintained separated during this phase of the operation. It is noted that other types of fiber opening apparatus, as well as air lay openers, may be substituted for the carding machines.

Doffers, such as roll doffers or air doffers, are connected with doffing machines to withdraw the carded fibers from the carding roll and deposit them onto a transport. It is noted that it is preferred both doffers be of the same type, however, this is not necessary.

The transports deliver the carded and doffed fibers into a reserve supply which acts to further blend the fibers and also to provide a constant supply of fibers for the next phase of the operation. Transports deliver the fibers from the reserve supplies to respective of feed chutes 10, 12 in the manner described in the afore referred to parent applications.

The transports may be in the form of conveyor belts or they may be in the form of air ducts. Fans may be provided to generate the air current to carry the fibers through the transports.

Figures 3, 4:
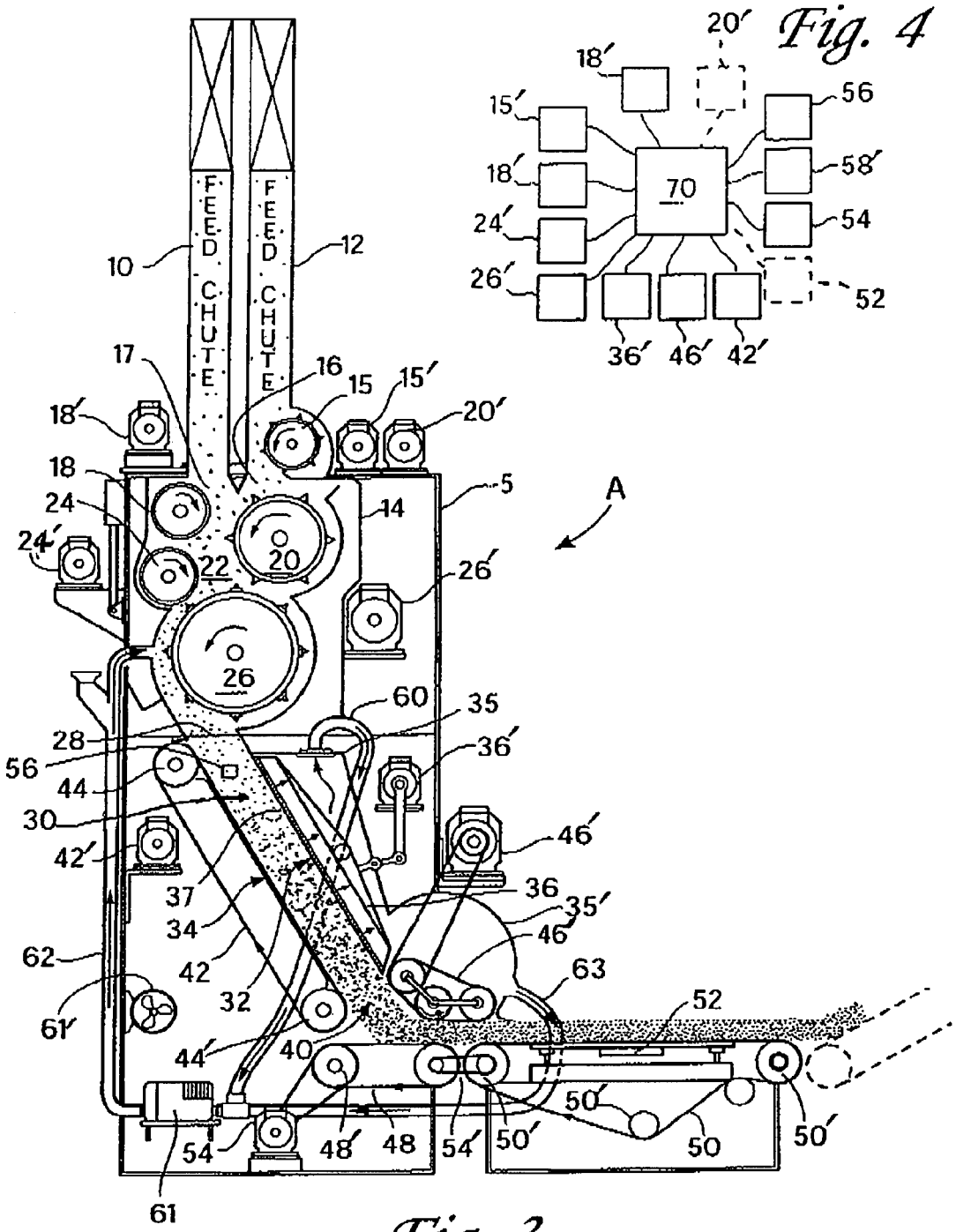
FIG. 3 is a side cutaway view of another arrangement of the air distribution apparatus in combination with perforated presser belts of the invention; and, FIG. 4 is a block diagram of the control for maintaining relative drive speeds.

Feed chutes 10, 12, as shown in FIGS. 1 and 3, are connected with housing 14 which is formed within a cabinet 5.

Fiber discharge openings 16, 17 are arranged in the upper surface of housing 14. Feed rolls 15 and 18 are located adjacent opening 16 and 17 and are adjustably driven to rotate in clockwise and counterclockwise directions as indicated. Feed roll 20 is located between and below feed rolls 15 and 18 and rotates in a counterclockwise direction. Preferably, the diameter of feed rolls 15 and 18, which is about 6 inches in diameter, is about half the diameter of feed roll 20.

Feed rolls 15, 18 and 20 are driven by independent drive motors 15', 18' and 20' which are each controlled to selectively drive the feed rolls at selected RPM's. The speed selected is determined by sensors which usually control feed rolls 15, 18 and 20 to have the same peripheral speed. A median peripheral speed for these feed rolls is between 0 and 20 m/min. In cases where the mixture of fibers from chutes 10 and 12 is to be unequal, the relative peripheral speed between rolls 15, 18 and 20 is adjusted to obtain the desired mixture.

The feed rolls deliver the fibers into mixing chamber 22 where they are further opened and blended. At the lower end of mixing chamber 22 there is located a combing roll 24 and a beater roll 26. Combing roll 24 along with feed roll 20 acts to pick up fibers in the mixing chamber and wipe and deliver them onto the outer surface of beater roll 26. The beater roll, in turn, acts to further open and blend the fibers as they are moved through the beater chamber during delivery into receiving end 28 of forming chute 30.

Comber roll 24 and beater roll 26 are driven by motors 24' and 26' at selected speeds. The selected speed chosen for each of rolls 15, 18, 20, and 26 is determined by the fiber blend desired and by the fiber volume necessary to form the fiber batt or non-woven fabric at the desired density and weight in forming chute 30.

The peripheral surfaces of feed rolls 15, 18, 20, of comber roll 24 and of beater roll 26 are formed of pin-like members of usual construction. Normally, the pins are arranged in parallel transverse rows, however, in the case of at least feed roll 20, it has been found to be desirable to arrange the pin rows in a helical pattern. Such a pattern of teeth acts to more evenly wipe the fibers onto beater roll 26.

A forming chute or chamber 30 is of usual rectangular shape with an upper wall 32 and a lower wall 34 spaced by a pair of equal sized sides. Upper wall 32 includes a housing 35, one side of which comprises vibrating plate 38. Vibrating plate 36 extends across the width of upper wall 32 and lengthwise of forming chute or chamber 30 from adjacent the upper end of wall 32 to the lower end of forming chute or chamber 30. Vibrating plate 36 forms the upper surface of discharge or delivery end 40 of the batt forming chute or chamber 30. Vibrating plate 36 is driven in a rocking motion about pivot 38' by motor 36' through linkage 38. The structure of forming chute 30 is maintained by vibrating plate 36 remaining in a relatively constant position relative to lower wall 34.

Hood or housing 35 is connected at one end with upper wall 32 above the upper end of vibrating plate 36 and extends downward to encompass compressor roll 46 with a shaped extension 35'. Connected with hood 35 adjacent vibrator plate 36 is an exhaust conduit 60 which extends to and is connected with blower or fan 61. A second exhaust conduit extends through hood extension 35' and is connected with packing member in the form of press roll 46 or press belt 46'. Conduit 63 is also connected with blower or fan 61. A third conduit 62 is connected with the outflow end of blower or fan 61 and extends to and is connected with mixing chamber 22.

Figure 2:
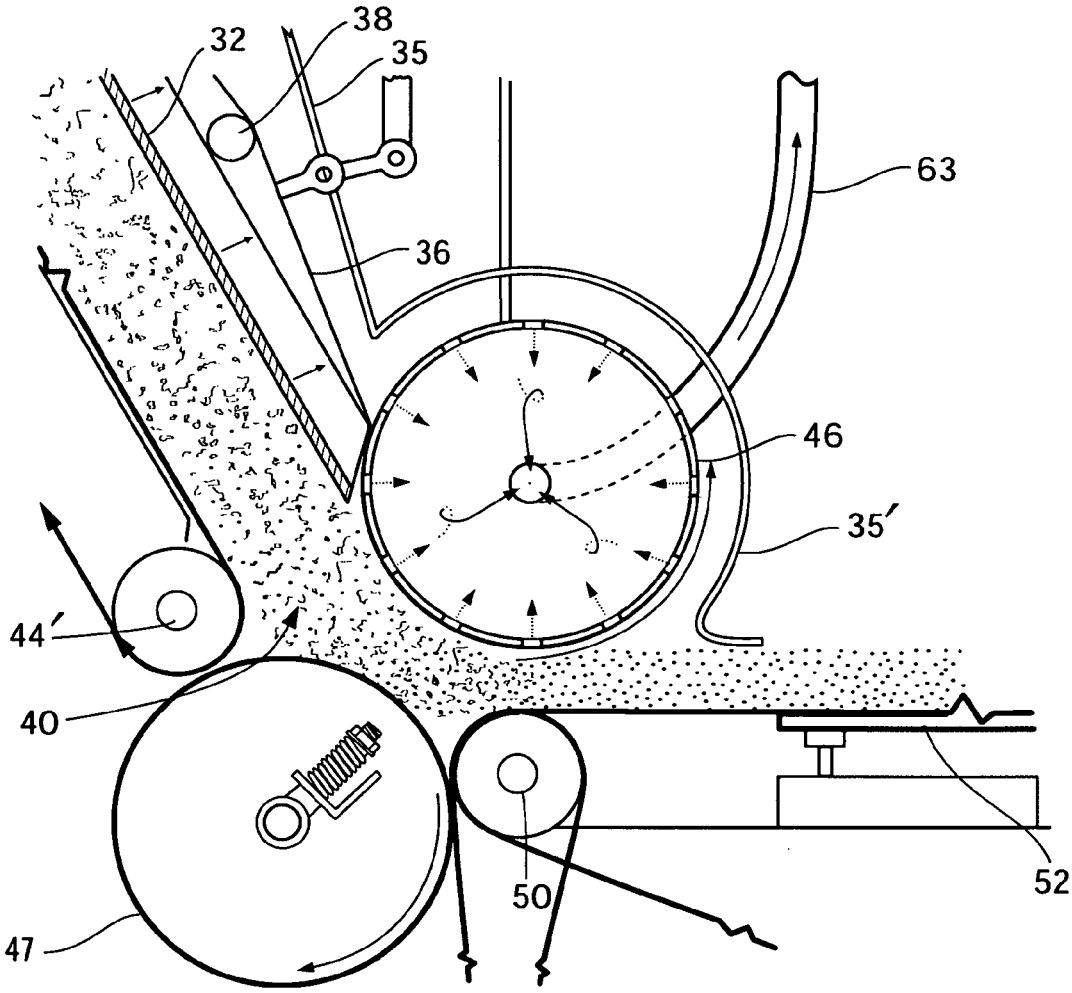
FIG. 2 is a sectional cutaway view of the compressor roll and web discharge area of another arrangement of the invention.
Figure 2A:
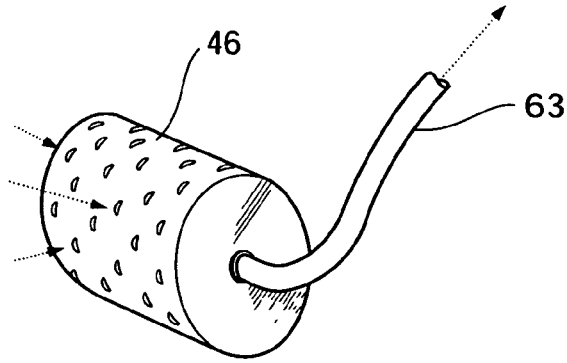
FIG. 2*a* is an exploded view of the compressor roll of the invention.

Vibrating plate 36, along its lower surface 37, is provided with perforations or with an air outlet comb as indicated by the arrows. Also, press member 46 is provided with perforations as denoted by arrows in FIGS. 2, 2*a*. This arrangement allows blower 61 to draw air in a closed loop in the direction of the arrows, from forming chute 30 through the fibers located therein, through vibrating plate 36 and conduit 60, through press roll 46 and conduit 63, back into mixing chamber 22 through conduit 62 as indicated by the arrows. In an open loop, however, 61 will draw air from the vibrating plate and press roll or belt and deliver it to a filter where a second blower 61' will draw a fresh air and blow it to mixing chamber 22.

The velocity of the air flow through conduit 62 into mixing chamber 22 is lower than the velocity of beater roll 26 and plays no significant roll in moving the blended and opened fibers through receiving end 28 of chute 30. As the air flow moves through chute 30 it acts to move or urge the fibers toward the upper side of chute 30 which assists in more evenly distributing the fibers preventing compacting toward the lower area of the web adjacent lower chute wall 34 by the movement of packing belt 42. The low air flow further helps to maintain the fibers oriented in all directions which provides for greater stability for the fiber web.

Further, as the web exits delivery end 40 and engages with press roll 46, air, as it continues to be drawn through the fiber web and through press roll 46, acts to maintain the fibers in evenly distributed positions throughout the upper portion of the web, and particularly, adjacent the upper surface as the web which is compacted between press roll 46 and conveyor belt 48. The action of the air through the web in the area of press roll 46 better compacts the web and acts to prevent shorter or smaller fibers in the upper area of the web from filtering downward into the lower area of the web. The action of the air in this area of the production process provides a smoother upper web surface and a web in which the fibers are more evenly distributed than was before attainable. From hood or housing 35 and press roll 46, the air returns through conduits 60, 63, blower 61, to mixing chamber 22, where the cycle is repeated.

Turning now to FIG. 4, a block diagram of the control system is shown. Control 70, which may be a computer, is connected with fiber volume sensor 56, press roll sensor 49 and/or scale sensor 52. Control 70 is also connected with motor 15' and 18', motor 20', motor 24', motor 26', motor 36', motor 42', and motor 54.

In operation, fibers from two sources are fed through feed chutes 10 and into mixing chamber 22. The relative peripheral speeds of feed rolls 15, 18 and 20 are set at predetermined individual rates. Control 70 provides signals which control motors 15', 18' and 20' at the selected speeds.

The opened and blended fibers are moved from the mixing chamber by combing roll 24 and beater roll 26 into receiving end 28 of batt forming chute 30. The combing roll and beater are driven at a selected speed by motors 24' and 26' which are under the control of control 70. Packing belt 42 and vibrating plate 36 assist in moving the free falling fibers down batt forming chute 30 forming a fiber batt in the lower portion thereof. Motors 36' and 42', also under the control of control 70, move the packing belt and vibrating plate at desired and relative speeds.

The fiber volume within batt forming chute 30 is constantly monitored by sensor 56. A sensing of other than the desired fiber volume causes sensor 56 to signal control 70 of the deficiency. Control 70 responds by causing motors 18' and 20' or motors 18', 20', and 26' to increase or decrease their RPM's within selected limits to increase or decrease the fiber input. In this manner, the fiber volume in batt forming chute 40 is maintained at the desired level.

As the formed fiber batt emerges from delivery end 40 and is compressed by press roll 46, the position of press roll 46 is sensed by sensor 58' which sends a signal to control 70. Control 70 determines the density of the fiber batt, compares that density against a norm and causes motors 36' and 42' to increase or decrease their RPM's as dictated by the density comparisons, in this arrangement, it is sometimes desirable to only control motor 42' to vary its RPM's.

Alternatively, press roll 46 may not be equipped with a sensing arrangement. in this event, scale 52 is arranged to cooperate with conveyor belt 50 as the fiber batt is delivered to further processing. As the fiber batt is being passed over conveyor belt 50, scale 52 weighs the fiber batt and signals control 60. Control 60, in response to that sensing, determines the fiber batt density, compares that density with a norm, and signals motors 36' and 42' or just motor 42' to adjacent RPM's accordingly, or change location of packing belt assembly to reduce or enlarge the distance of the vibrating wall according to the compared weight to the set point.

The velocity of the air flow is preferably lower than the fiber velocity created by beater 26 with the preferred velocity lower than 1 meter/second with the pressure of the air flow between 1-100 millimeters water gauge.

If desired the air flow assembly may include a distributor connected with conduit 62 as shown in FIG. 1*a*. The distributor may be utilized to add chemicals or additives into the air flow which can act to reduce the static load or charge in the fibers during passage through forming chute 30. The chemicals or additives may alternatively act to reduce flammability of the fiber web, increase or bring about the bonding capability of the fibers or produce other desired characteristics.

Any known type of distributor may be utilized to carry the fiber conditioner. It could comprise heated or cooled air.

Another capability of distributor 60*a* could be to increase the humidity temperature within cabinet 5.

It is noted that the location and size of fan 61 may be varied as desired. Also, the location of conduits 60, 62 and 63 may also be changed to other areas of cabinet 14 and housing 35. A preferred alternative arrangement for the conduits and fan is shown in FIG. 3 with like numerals identifying like components. The air system may be a closet loop system or it may be an open loop system.

Lower wall 34 carries packing belt 42 which extends over substantially its entire area. Packing belt 42 which is continuous, passes around roller 44 which is arranged near the upper end of lower wall 34 and around the roller 44' which is arranged at delivery end 40 of the batt forming chute. Motor 42' drives roller 44 and packing belt 42 in a clockwise direction. The packing belt acts along with the just described air flow to physically assist the movement of the fibers from receiving end 28 down forming chute 30 in which the fiber web or non-woven fabric fiber is formed. The air flow may, if desired, also act to physically treat the fibers as earlier described. The fiber orientations are more evenly maintained throughout the batt forming chute, and as the batt exits delivery end 40 and engages between belt 48 and press roll 46. Also, the fiber density throughout the fiber web is more evenly maintained between the bottom and top surfaces of the fiber web.

Press roll 46, which is driven by motor 46', acts to compress and draw the formed fiber batt out of delivery end 40 of the batt forming chute. Interactions with the air flow continues to assist in the distribution of the fibers while producing a smoother and better compacted upper surface.

It is the combined operations of vibrating plate 36 and packing belt 42 which draw and urge sufficient quantities of fibers toward delivery end 40. The fiber volume of the web can be controlled by the speed of the vibrator plate, the air velocity, and the speed of the packing belt. Press roll 46 acts to compact the formed fiber web 1 to a desired height providing a non-woven fabric or fiber web having a smooth upper surface and with desired entanglement, body, weight, and height.

Arranged on the lower end of vibrator plate 36 there may be provided a fiber inter-engaging device in the form of a needle bed 7 best described in U.S. Pat. No. 6,557,214, which includes needles which penetrate into the upper area of fiber forming chute 30 to engage and entangle the upper outer fibers of the fiber web passing out delivery end 40.

The formed fiber web is carried away by belts 48 and 50 as earlier described.

The formed fiber web is carried away by belts 48 and 50 as earlier described.

An alternative to this arrangement could be to provide that lower press roll 46 a heated roll. As such, press roll 46 would function as a fiber inter-engaging device as the outer fibers of the lower fiber web surface could be inter-engaged by bonding with adjacent ones. This bonding could be brought about by utilizing at least some of the fibers as a synthetic fibers with low melt characteristics. An alternative would be to introduce bonding materials through distributor 60*a* and conduit 60 to be inter-dispersed among the fibers forming the fiber batt. The outer fibers adjacent the lower surface would then be inter-engaged.

The fiber batt forming system of the invention operates as previously described. As the formed fiber batt departs the delivery end and passes between press roll 46 and belt 48 or press belt 46', in route to belt 50. As the formed fiber web leaves belt 50 it may be passed through heating rolls which function as a fiber inter-engaging device and interact with fibers adjacent the upper and lower outer surfaces of the fiber web. Again, these fibers are inter-engaged by bonding.

The arrangements described and shown are operative to produce lightweight fiber webs of no more than 100 grams per square meter or high weight fiber webs of up to 10,000 grams per square meter having stabilized outer surfaces. The density between fiber webs is controlled by its height relative to its weight.

Conveyor belt 48 is arranged adjacent delivery end 40 and acts to receive the fiber web emerging from the delivery end. Conveyor belt 48, which passes around rollers 48', acts as a back wall against the force exerted by roll 46 or press belt 46' and further acts as a delivery belt for moving the formed fiber web onto conveyor belt 50.

Conveyor belt 50 passes about rollers 50'. Motor 54 which is connected with a roller 48' also drives conveyor belt 50 through drive belt 54'.

As the fiber web or non-woven fabric exits delivery end 40 it passes between press roll 46 or press belt 46' and belt 48 and along belts 48 and 50 as previously described.

Press belt 46' could be constructed with perforations to allow the air to move through the fibers, as shown in FIG. 3. The perforated belts act to compress the fiber web while allowing the air to be circulated as previously described.

Normally, only one of press roll 46 or conveyor belt 50 is provided with a sensing device.

While preferred arrangements of the invention have been described using specific terms, such description is for illustrative purposes only, and it is to be understood that changes and variations may be made without departing from the spirit or scope of the following claims.

What is claimed is:

1. An arrangement for forming a fiber web in which fibers remain evenly distributed throughout and compacted on both the upper and lower surfaces of said web comprising:

a housing receiving opened and blended fibers;

a fiber web forming chute receiving said opened and blended fibers from said cabinet, said fiber web forming chute having an upper and a lower wall which are driven to assist with the movement of the fibers through and out an exit end of said web forming chute;

individual drive members driving said upper and lower walls at individually selected speeds depending upon the fiber volume needed;

a packing member adjacent said exit end engaging and compressing said emerging fiber web to a desired density and height;

a sensor carried by said packing member and associated with said drive members;

an air flow system passing a flow of air into said forming chute entrance, said air flow engaging with said fibers during passage thereof through said forming chute, said air flow system including an air removal system in said upper wall of said forming chute and in said packing member, said air removal system causing said air to exit upwardly through said fiber web and out through said upper wall and said packing member as said fiber web passes through and out of said forming chute and beneath said packing member; wherein, said air flow engaging with said fibers maintains said fibers evenly distributed between upper and lower surfaces of said web during formation thereof and said sensor is activated by the position of said packing member to control the rates of said drive members in accordance with the desired height and density of said fiber batt being formed.

2. The system of claim 1 wherein said packing member comprises a perforated press roll.

3. The system of claim 1 wherein said packing member comprises a perforated press belt.

4. The system of claim 1 wherein the air flow system includes a housing about said upper wall and said packing member.

5. An arrangement for forming a fiber web in which the fibers are more evenly distributed adjacent outer surfaces thereof comprising:

first and second chutes, receiving, respectively first and second batches of opened and blended fibers;

a mixing chamber beneath said chutes for receiving said opened and blended fibers from said chutes in selected quantities;

first and second independently driven feed rolls positioned adjacent exit ends of said first and second chutes and adjacent an upper portion of a mixing chamber;

a third feed roll, a comber roll and a beater roll within said chamber and spaced from said chute exit ends;

a fiber batt forming chamber having an entrance adjacent said mixing chamber exit and a delivery end, said forming chamber including a packing belt;

a press member adjacent said delivery end of said forming chamber;

independent drives for each of said feed rolls, for said corner roll, for said beater roll, for said packing belt and for said press roll;

a control for individually controlling each of said drives; wherein individually selected quantities of said opened and blended fibers of said first batch and said second batch are delivered into said mixing chamber by said first and second feed rolls, said first and second quantities of said fibers are further blended within said chamber by said third feed roll, said comber roll and said beater roll, all driven at individually selected speeds, said beater roll passing said further opened and blended fibers into said fiber batt forming chamber where said fibers are compacted into a fiber batt which is passed through said delivery end and beneath said press member compacting said fiber batt into a desired density.

* * * * *